United States Patent [19]

Wakamiya

[11] 4,283,899

[45] Aug. 18, 1981

[54] ANCHOR BOX EMBEDDED IN CONCRETE

[75] Inventor: Masatoshi Wakamiya, Yokohama, Japan

[73] Assignee: Bridgestone Tire Co., Ltd., Tokyo, Japan

[21] Appl. No.: 92,308

[22] Filed: Nov. 8, 1979

[30] Foreign Application Priority Data

Nov. 22, 1978 [JP] Japan ..... 53-143545
Nov. 24, 1978 [JP] Japan ..... 53-160673

[51] Int. Cl.[3] ..... E04B 1/41
[52] U.S. Cl. ..... 52/699
[58] Field of Search ..... 52/704, 711, 699, 710, 52/708, 701, 707, 787; 85/32 K; 411/6, 82

[56] References Cited

U.S. PATENT DOCUMENTS

| | | | |
|---|---|---|---|
| 917,927 | 4/1909 | Cook | 52/704 |
| 1,090,486 | 3/1914 | Lohmann | 52/711 |
| 1,185,765 | 6/1916 | Brooks | 52/699 |
| 1,206,601 | 11/1916 | Schramm | 52/711 |
| 1,212,990 | 1/1917 | New Hall | 52/711 |
| 1,265,064 | 5/1918 | Donley | 52/701 |
| 1,314,854 | 9/1919 | Cain | 52/710 |
| 1,351,112 | 8/1920 | Martin | 52/711 |
| 1,761,800 | 6/1930 | Preis | 52/704 |
| 2,560,951 | 7/1951 | Henderson | 52/708 |
| 3,313,078 | 4/1967 | Rohe | 52/708 |
| 3,504,723 | 4/1970 | Cushman | 52/787 |
| 3,854,371 | 12/1974 | Lamothe | 52/699 |

FOREIGN PATENT DOCUMENTS

| | | | |
|---|---|---|---|
| 1213108 | 3/1960 | France | 52/699 |

*Primary Examiner*—John E. Murtagh
*Attorney, Agent, or Firm*—Sughrue, Mion, Zinn, Macpeak andSeas

[57] ABSTRACT

An anchor box embedded in concrete comprising a trunk body for defining a fastening bolt insertion hole, and an anchor nut held by the rear portion of the trunk body and adapted to be threadedly engaged with the fastening bolt. The fastening bolt insertion hole is terminated at a temporary connection flange for temporarily connecting the trunk body to a face plate of a concrete placing mold frame.

6 Claims, 1 Drawing Figure

ANCHOR BOX EMBEDDED IN CONCRETE

BACKGROUND OF THE INVENTION

1. Field of the Invention

This invention relates to an anchor box embedded in concrete and for retaining an anchor nut in concrete.

2. Description of the Prior Art

In the case of constructing concrete structures such, for example, as a quay wall in harbor facilities, it has been the common practice to embed beforehand an anchor bolt in the quay wall concrete for the purpose of fitting a marine fender or the like to the front surface of the quay wall.

Such an anchor bolt is provided at its one end with a threaded portion and at its opposite end with a proper rotation preventive means. The anchor bolt is embedded in concrete with the threaded end exposed out of the concrete and after the concrete structure has been hardened, the exposed threaded end is engaged with a nut. However, when the nut is fastened to a proper position, it is inevitable that the threaded end portion of the anchor bolt protrudes from the nut. As a result, such anchor bolt enbedded in concrete is unsuitable for fitting a marine fender to the quay wall.

That is, the anchor bolt embedded in concrete has the disadvantages that the exposed threaded portion thereof is corroded by splashes of sea water or the like, that the protruded surplus threaded portion causes the effective stroke of deformation of the marine fender to make small, and there is a risk that hulls of ships will be damaged.

In order to effectively overcome the above mentioned drawback, an anchor nut may be embedded in the concrete structure. But, in this case, it is difficult to determine the position of the anchor nut during concrete placing work. In addition, there is a risk of tapped holes being clogged with concrete. Moreover, a fastening bolt insertion hole tends to be easily misaligned with the anchor nut.

In order to overcome such disadvantage, if the anchor nut is combined beforehand with the fastening bolt or an auxiliary bolt and eventually with a stay pipe for the purpose of determining the position of the anchor nut with respect to a concrete placing molding frame, there is a risk of the bolt or the like, which is to be taken out of the concrete after the concrete has been hardened, being firmly secured to the concrete, thereby rendering the workability extremely difficult.

SUMMARY OF THE INVENTION

An object of the invention, therefore, is to provide an anchor box embedded in concrete for retaining an anchor nut in concrete, which can easily determine a precise position of the anchor nut and which can effectively eliminate the above mentioned drawbacks which have been encountered with the prior art techniques.

A feature of the invention is the provision of an anchor box embedded in concrete comprising a trunk body for defining a fastening bolt insertion hole, and an anchor nut held by the rear portion of said trunk body and adapted to be threadedly engaged with said fastening bolt.

Further objects and features of the invention will be fully understood from the following detailed description with reference to the accompanying drawing, wherein:

DETAILED DESCRIPTION OF THE PREFERRED EMBODIMENT

Figure 1:
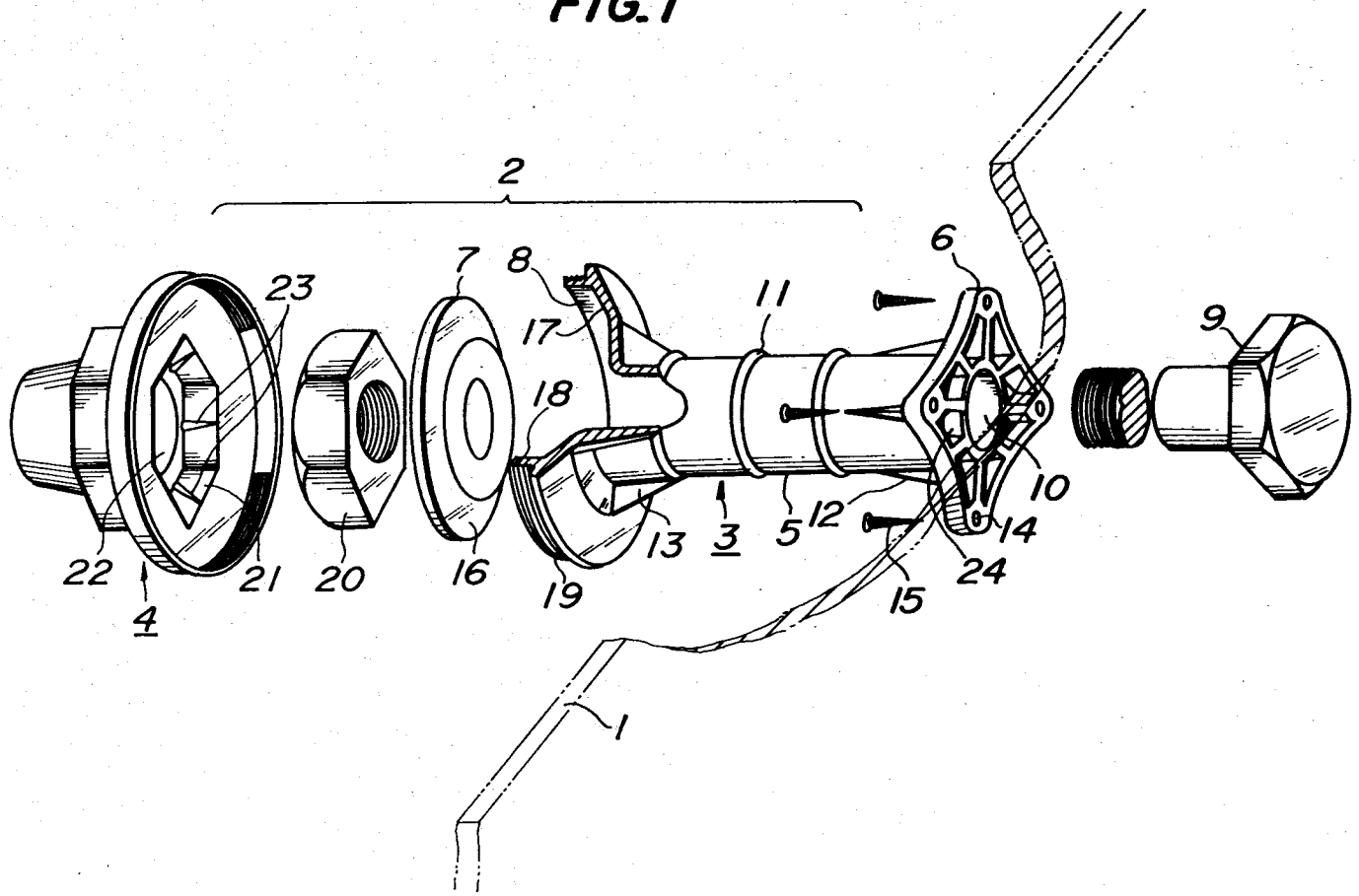
FIG. 1 is a fragmentary perspective view of one embodiment of an anchor box embedded in concrete according to the invention.

FIG. 1 shows one embodiment of an anchor box embedded in concrete according to the invention in fragmentary form. In FIG. 1, reference numeral 1 designates a face plate of a mold frame for forming a quay wall front surface, and 2 shows an anchor box embedded in concrete for retaining an anchor nut in concrete according to the invention. It comprises a cylinder-shaped trunk body 3 and a cap 4.

The trunk body 3 is composed of a hollow cylinder provided at that front end thereof which is opposed to the face plate 1 with a temporary connection flange 6 for temporarily connecting the trunk body 3 to the face plate 1 and at the opposite rear portion thereof with a receptacle 8 for a washer 7. The trunk body 5 defines an insertion hole 10 for a fastening bolt 9. The hole 10 is composed of a tapered hole diverging toward the front end of the hole 10 so as to allow easy insertion of the fastening bolt 19 into the hole 10.

It is preferable that the trunk body 5 is provided at its outer periphery with circumferential reinforcing ribs 11, that the temporary connection flange 6 is provided at its rear surface with transversely extending and inclined reinforcing ribs 12 connected therewith. The receptacle 8 is provided at its front surface with transversely extending and inclined reinforcing rib 13 connected therewith.

The temporary connection flange 6 is secured to the face plate 1 by means of screws 15 passing through holes 14 provided at the periphery of the temporary connecting flange 6 for the purpose of holding the anchor box 2 at its normal position.

As shown in FIG. 1, it is preferable to provide on the inner surface of the receptacle 8 with a tapered seat 17 adapted to be closely engaged with a tapered surface 16 of a metal washer 7 which is relatively large in thickness. It is also preferable to provide on the outer surface of the receptacle 8 with a tapered surface. These inner and outer tapered surfaces of the receptacle 8 function to distribute compressive stress due to a pulling force exerted onto the metal washer 7 when the fastening bolt 9 is threaded into the hole 10. It is also preferable to provide on the outer periphery of a rim 18 of the receptacle 8 with threads 19 adapted to be threadedly engaged with the cap 4. Alternatively, the threads 19 may be replaced by snap claws for firmly clamping the cap 4 when it is engaged with the receptacle 8.

The cap 4 is provided with a cavity which is opposed to the anchor nut 20 with a rotation preventive hole 21 and at the rear of the cavity with a blind hole 22 adapted to be engaged with that threaded end of the fastening bolt 9 which extends through and projects out of the anchor nut 20. The rotation preventive hole 21 may preferably be provided with firmly clamping ribs 23 equally and circumferentially spaced apart from each other and each having a height which becomes higher toward the rear portion thereof.

The face plate 1 functions to define the configuration of the front surface of concrete placed in a concrete placing space shown at the left side in FIG. 1. This front surface of concrete forms a concrete structural body, for example, a quay wall surface. As a result, that position on the quay wall surface fitted with a marine fender can be predetermined by the inner surface of the face plate 1. Thus, it is clear that if the temporary connecting flange 6 of the anchor box 2 is closely fitted to and firmly secured to the face plate 1, the embedded position of the anchor nut 20 held in the anchor box 2 can precisely be determined.

After concrete has been placed, the anchor box 2 is left as it is embedded in concrete of the concrete structural body such as the quay wall. But, after the face plate 1 has been removed, the bolt insertion hole 10 is opened at its normal position. The mutual distance between adjacent bolt insertion holes 10 can easily and precisely be determined by merely connecting the anchor box 2 to the face plate 1 at a given position. As a result, the dangerous and troublesome work of fitting a giant marine fender to the front surface of the quay wall can be carried out in a simple manner.

As seen from the above, the anchor box 2 is supported at its one end by the temporary connection flange 6 and provided at a position near the free end thereof with the heavy anchor nut 20 and washer 7. As a result, the anchor box 2 is subjected to a large moment and hence the temporary connecting flange 6 tends to be separated from the face plate 1. In addition, the anchor box tends to be inclined downwardly due to shocks produced when concrete including large aggregates is randomly placed.

Such downward inclination of the anchor box 2 causes the upper side of the temporary connecting flange 6 to widely separate from the face plate to form a large gap. As a result, concrete leaks through this large gap into the insertion hole 10 of the fastening bolt 9 and becomes solidified, thereby clogging the insertion hole 10.

In the present embodiment, the temporary connection flange 6 is provided at the surface thereof which opposes the face plate 1 and which surrounds the insertion hole 10 with depressions 24. As a result, the concrete fluid component penetrated into the gap formed between the temporary connection flange 6 and the face plate 1 flows into the depressions 24 and seized therein and solidified before it reaches the insertion hole 10. Thus, there is no risk of the insertion hole 10 being clogged with solidified concrete. It is preferable to define the depressions 24 by radially extending ribs as shown in FIG. 1 to reinforce the temporary connection flange 6.

In the anchor box according to the invention, the trunk body is detachably connected to its cap by means of threads or springs. As a result, the trunk body can precisely be connected to the face plate of the concrete mold frame and inspection and selection of the anchor nut can easily be effected. Thus, it is possible to effectively avoid concrete repair work in large scale due to the presence of a defective anchor nut embedded in concrete. In addition, the use of the circumferential reinforcing ribs ensures a provision of a fastening bolt insertion hole with the thickness and weight of the trunk body wall reduced. Moreover, the use of the transverse reinforcing ribs for connecting the temporary connection flange and receptacle to the trunk body ensures an effective reduction of deformation of the anchor box, thereby making the anchor box long.

In the anchor box according to the invention, both the trunk body and the cap may be formed of metals, particularly material which does not corrode the fastening bolt such, for example, as zinc or the other highly corrosion resistant material, particularly plastics such as ABS (Acrylonitrile Butadiene Styrene) resin.

As stated hereinbefor, the invention is capable of completely shielding the inside of the anchor box 2 including the anchor nut 20 and washer 7 incorporated therein against shock and fluid movement produced when concrete is placed. As a result, there is no risk of the related position between the tapped hole of the anchor nut 20 and the insertion hole 10 of the fastening bolt 9 being misaligned and hence the fastening bolt 9 can precisely be threaded with the anchor nut 20 without being impeded by leakage and penetration of concrete.

What is claimed is:

1. An anchor box embedded in concrete comprising; a trunk body formed of plastic and defining a fastening bolt insertion hole, an anchor nut held through a metal washer by the rear portion of said trunk body and adapted to be threadedly engaged with said fastening bolt, a cap formed of plastic and adapted to be connected with said trunk body, said cap having a hole for holding said anchor nut against rotation and detachably threaded with said trunk bolt, and said washer being provided at its front side with a tapered surface.

2. The anchor box embedded in concrete according to claim 1, wherein said trunk body is provided at its front end with a temporary connection flange for temporarily connecting said trunk body to a face place of a concrete placing mold frame.

3. The anchor box embedded in concrete according to claim 2, wherein said trunk body is composed of a hollow cylinder provided at its rear portion with a washer receiving receptacle and said cap is adapted to be connected with said receptacle.

4. The anchor box embedded in concrete according to claim 1, wherein said trunk body is provided at its outer periphery with circumferential reinforcing ribs.

5. The anchor box embedded in concrete according to claims 2 or 3, wherein said trunk body is provided with a reinforcing rib inclined upwardly toward at least one of said temporary connection flange and said washer receiving receptacle.

6. The anchor box embedded in concrete according to claim 2, wherein said temporary connection flange is provided at that surface thereof which is opposed to said face plate and which surrounds a fastening bolt insertion hole with depressions.

* * * * *